US006979206B2

(12) United States Patent
Bu et al.

(10) Patent No.: US 6,979,206 B2
(45) Date of Patent: Dec. 27, 2005

(54) CARD EDGE CONNECTOR

(75) Inventors: Xue Wu Bu, Kunsan (CN); DeXi Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,312

(22) Filed: Dec. 28, 2004

(65) Prior Publication Data

US 2005/0153585 A1 Jul. 14, 2005

(30) Foreign Application Priority Data

Jan. 13, 2004 (CN) ..... 2004200243039

(51) Int. Cl.[7] ..... H01R 9/09
(52) U.S. Cl. ..... 439/79; 439/80
(58) Field of Search ..... 439/79, 80

(56) References Cited

U.S. PATENT DOCUMENTS 4,756,694 A 7/1988 Billman et al.
5,591,036 A 1/1997 Doi et al.
5,980,272 A * 11/1999 McHugh et al. ..... 439/79
6,093,032 A * 7/2000 McHugh et al. ..... 439/79
6,168,464 B1 1/2001 Choy et al.
6,551,116 B1 * 4/2003 Liu ..... 439/79
6,855,000 B2 * 2/2005 Wu ..... 439/484
6,866,538 B2 * 3/2005 Lee ..... 439/404
6,884,112 B1 * 4/2005 Juntwait et al. ..... 439/573
6,887,108 B2 * 5/2005 Wu ..... 439/638

* cited by examiner

*Primary Examiner*—Gary Paumen
*Assistant Examiner*—Phuongchi Nguyen
(74) *Attorney, Agent, or Firm*—Wei Te Chung

(57) ABSTRACT

A card edge connector (1) includes an insulating housing (2), two rows of contacts (3) and a cover (4). The insulating housing (1) includes a front mating surface (27) and a rear face (25). A retaining section (21) extends rearwards from the rear surface and defines a dove-tailed, retaining cavity (22) on a top surface (220) thereof. A retaining, through hole (23) is defined in the insulating housing and communicating with the retaining cavity (220). The cover includes a locating block (41) retained in the dove-tailed, retaining cavity and a locking portion (42) entering the retaining, through hole. Thus, the cover is mounted to the insulating housing (2) firmly to protect soldering tails (33) and medial portions (32) of the contacts outside the insulating housing.

1 Claim, 6 Drawing Sheets

CARD EDGE CONNECTOR

BACKGROUND OF THE INVENTION

1. Field of the Invention

The present invention relates to an electrical connector, particularly to a card edge connector mounted on a printed circuit board with a cover to protect electrical contacts thereof.

2. Description of Related Art

TW Patent publication No. 493,818 discloses a slanted type card edge connector. The slanted type card edge connector comprises an elongated insulating housing with a front mating face and a rear face. As the mating face is slanted against a printed circuit board (PCB), in a small space, many connectors can be mounted on the PCB without occupying much area of the PCB. A central slot is defined in the front mating face for receiving a module or a card. Two rows of passageways are defined in the two sidewalls of the central slot for receiving respective contacts. Mating portions of the contacts are configured to mate with the module or the card. Connecting tails of the contacts are bent toward the PCB and exposed outside the rear face of the insulating housing. In this case, the connecting tails of the contacts tend to be greatly deformed during subsequent transportation. As a result, the assembly of the connector to the PCB and the soldering performance between the connecting tails of the contacts and the PCB will be infected badly. Therefore, there is a need to provide a member to protect the connecting tails exposed outside the insulating housing.

U.S. Pat. No. 5,591,036 discloses an electrical connector of a right-angle header with a cover to protect contacts outside the insulating housing. The insulating housing of the electrical connector comprises a front main wall, an upper wall and a pair of vertical walls. Pairs of upper and lower guide rails extend rearward from the frond, main wall along inside surfaces of respective vertical walls. The cover is formed as an elongated plate made from insulating material, comprising a pair of latching arms. The cover is assembled with the insulating housing by engagement between the latching member and the guide rails. However, the pairs of guide tails increase the dimension of the card connector, which is not desirable from the standpoint of the compactness in the computer industry. U.S. Pat. No. 5,980,272 also discloses the similar structure including a pair of side latches/guide rails which are horizontally assembled to the housing.

Therefore, an improved slanted type card edge connector with a cover is required to overcome the disadvantage of the prior art.

SUMMARY OF THE INVENTION

Accordingly, an object of the present invention is to provide a slanted type card edge connector with a cover that can be assembled to housing of the connector firmly and protect contacts of the connector from being damaged.

In order to achieve the object set forth, a slanted type card edge connector includes an insulting housing, two rows of contacts and a cover. The insulating housing includes a front mating surface and a rear face. A central slot is defined in the front mating face. Two rows of passageways are defined through the housing transversely for receiving the contacts. Each of the contacts comprises a mating portion received in the passageway, a soldering tail extending outside the rear face of the insulating housing and a medial portion interconnecting the mating portion and the soldering tail. The soldering tails are bent downwards in a direction slanted to the frond, mating face of the insulating housing. A pair of clapboards protrudes rearwards from two opposite side edges of the rear face of the insulating housing. A retaining section extends rearwards from the rear surface and defines a dove-tailed, retaining cavity on top surface thereof. A retaining, through hole is defined in the insulating housing communicating with the dove-tailed, retaining cavity. The cover includes a locating block retained in the dove-tailed cavity and a locking portion entering the retaining, through hole. Therefore, the cover is mounted to the insulating housing firmly to protect the medial portions and the soldering tails of the contacts exposed outside the insulating housing.

Other objects, advantages and novel features of the invention will become more apparent from the following detailed description of the present embodiment when take in conjunction with the accompany drawings.

DETAILED DESCRIPTION OF PREFERRED EMBODIMENTS

Reference will now be made to the drawings to describe the present invention in detail.

Figure 1:
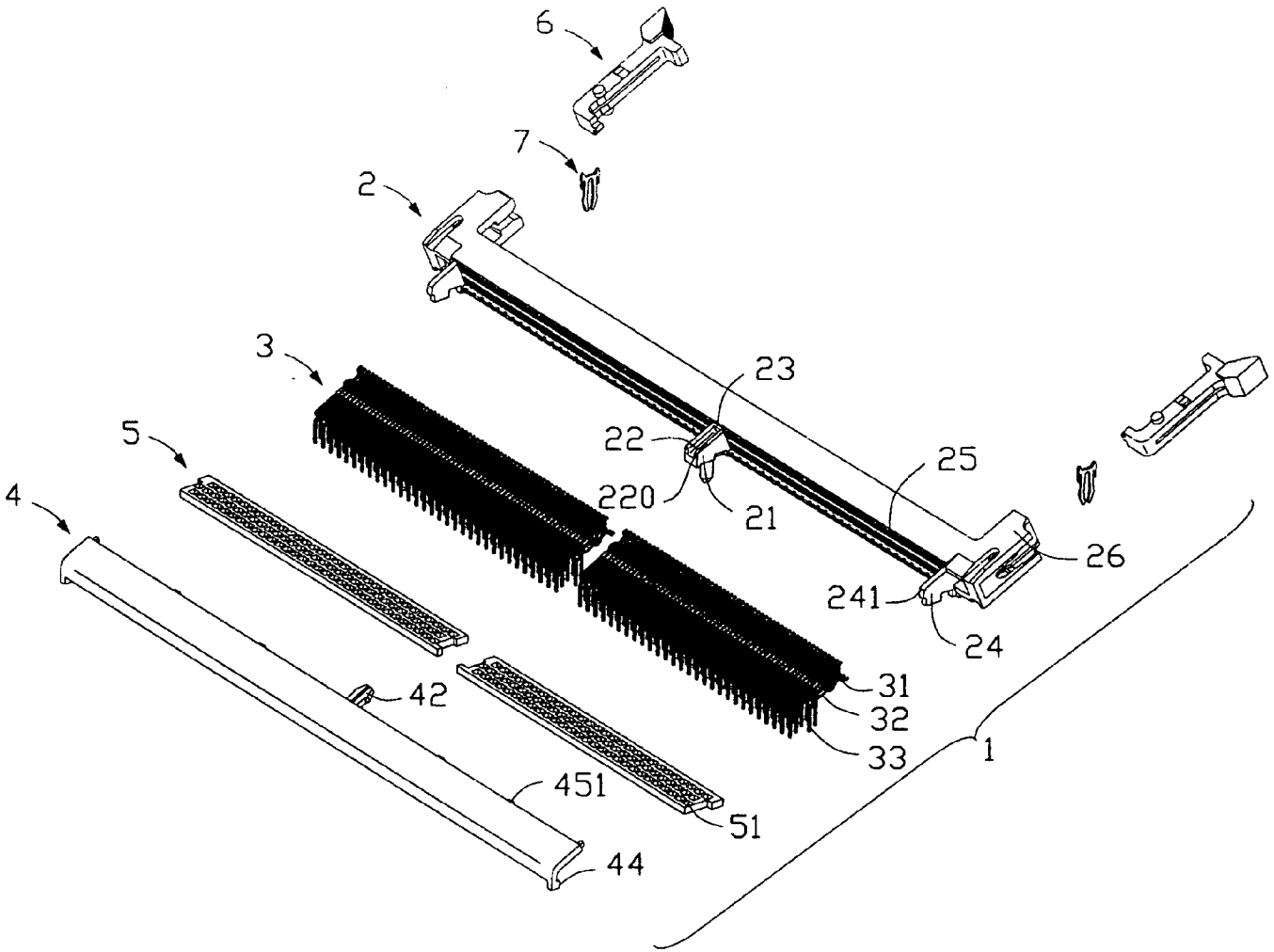
FIG. 1 is an exploded, perspective view of a slant type card edge connector in accordance with the present invention.
Figure 2:
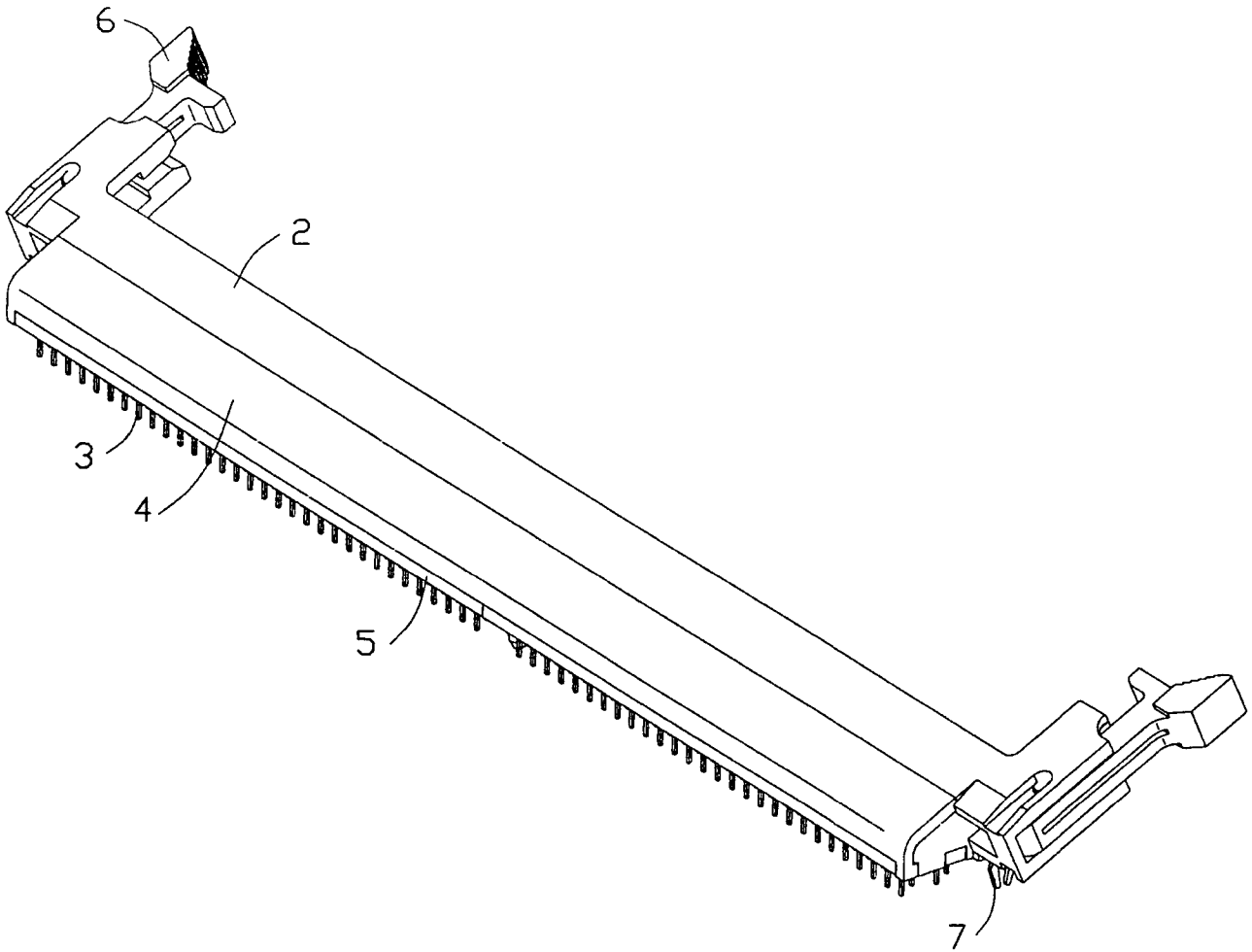
FIG. 2 is an assembled perspective view of the slant type card edge connector shown in FIG. 1.

Referring to FIG. 1, a slanted type card edge connector 1 in accordance with the present invention is indicated. The card edge connector 1 includes an insulating housing 2, a plurality of contacts 3, a cover 4, two spacers 5 for positioning the contacts 30, a pair of ejectors 6 for latching and ejecting a complementary mating electric card (not shown) and a pair of board-locks 7 for retaining the connector onto a printed circuit board (PCB) (not shown).

Figure 3:
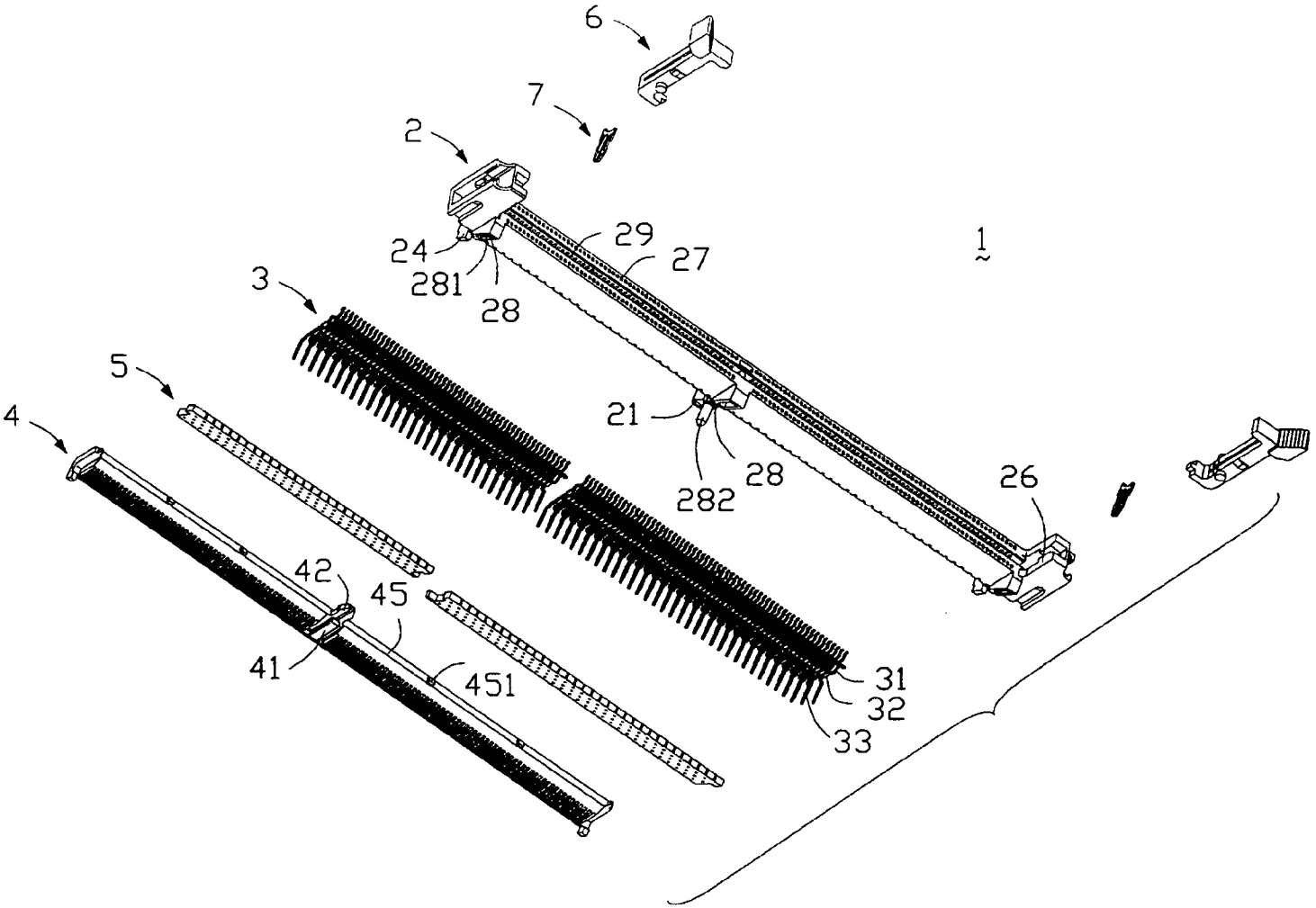
FIG. 3 is a view similar to the FIG. 1, but taken from another aspect.
Figure 5:
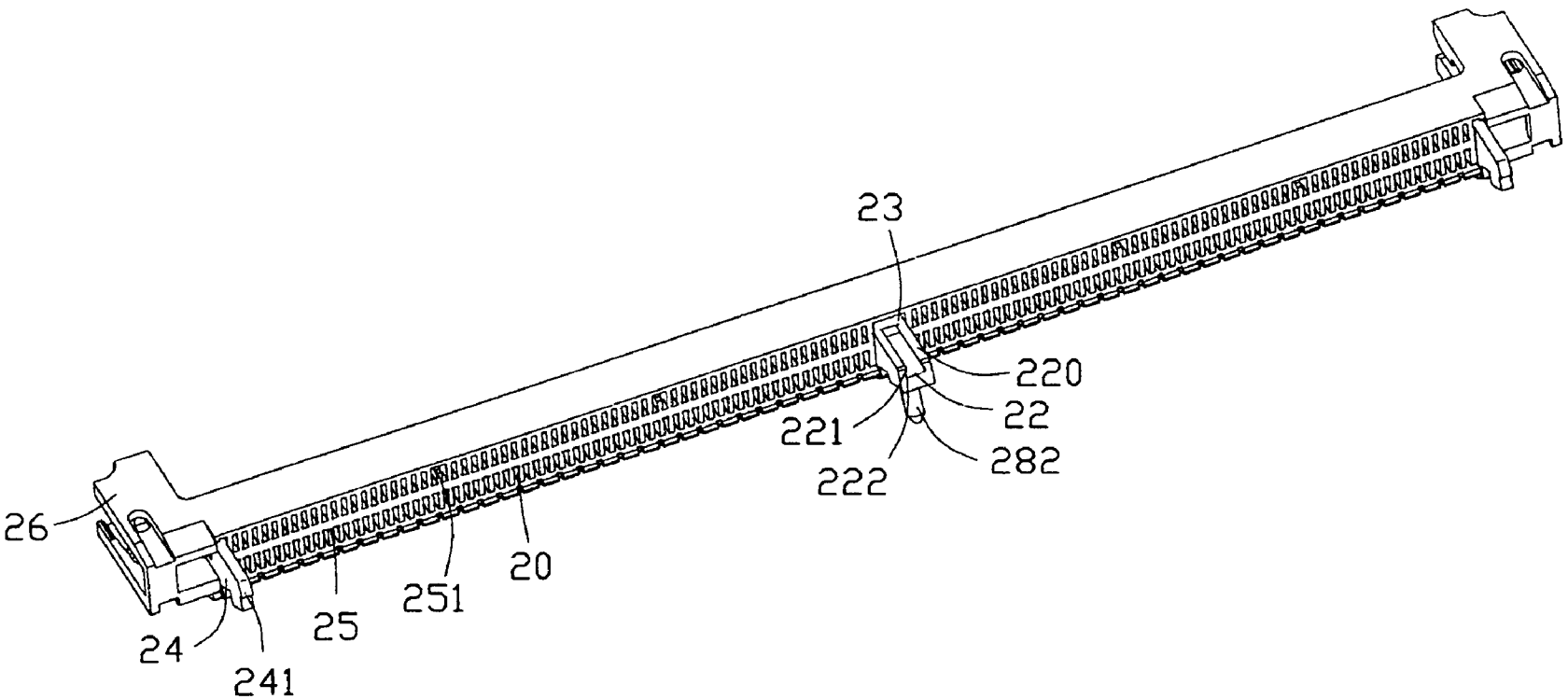
FIG. 5 is a perspective view of an insulating housing of the slanted type card edge connector in accordance with the present invention.

As shown in FIGS. 3 and 5, the insulating housing 2 extends along a longitudinal direction and includes a front mating face 27, a rear face 25 and a mounting face 28 facing to the PCB. The front mating face 27 is slanted to the mounting face 28 so that the connector 1 is mounted on the PCB at a certain degree. A central slot 29 is defined in the front mating face 27. Two rows of passageways 20 are provided by two sidewalls of the central slot 29 for receiving the contacts 3. A number of grooves 251 are defined in the rear face 25. A pair of board-lock retaining holes 281 is defined in the mounting surface 28 for retaining the board-locks 7. A pair of towers 26 extends forwardly from two opposite ends of the insulating hosing 2 for respectively receiving the pair of ejectors 6 therein. A pair of clapboards 24 protrudes rearwards from two opposite side edges of the rear face 25. A step 241 is formed at a rear side of each clapboard 24. A retaining section 21 extends rearwards from the rear face 25 of the insulating housing 2 and defines a dove-tailed, retaining cavity 22 on a top surface 220 thereof. In other words, a width of an upper side 221 of the dove-tailed, retaining cavity 22 is smaller than that of a lower side 222 thereof. A retaining post 282 projects from a bottom surface of the retaining section 21. A retaining, through hole 23 is defined in the insulating housing 2 communicating with the dove-tailed, retaining cavity 22. A protrusion (not shown) is formed on inner face of the retaining hole 23.

Referring to FIGS. 1 to 4, each contact 3 includes a mating portion 31 received in respective passageway 20 for mating with the complementary mating electronic card, a soldering tail 33 extending outside the rear face 25 of the housing 2 and a medial portion 32 interconnecting the mating portion 31 and the soldering tail 33. The soldering tails 33 are bent downward in a direction slanted to the front mating face 27 of the insulating housing 2.

Figure 6:
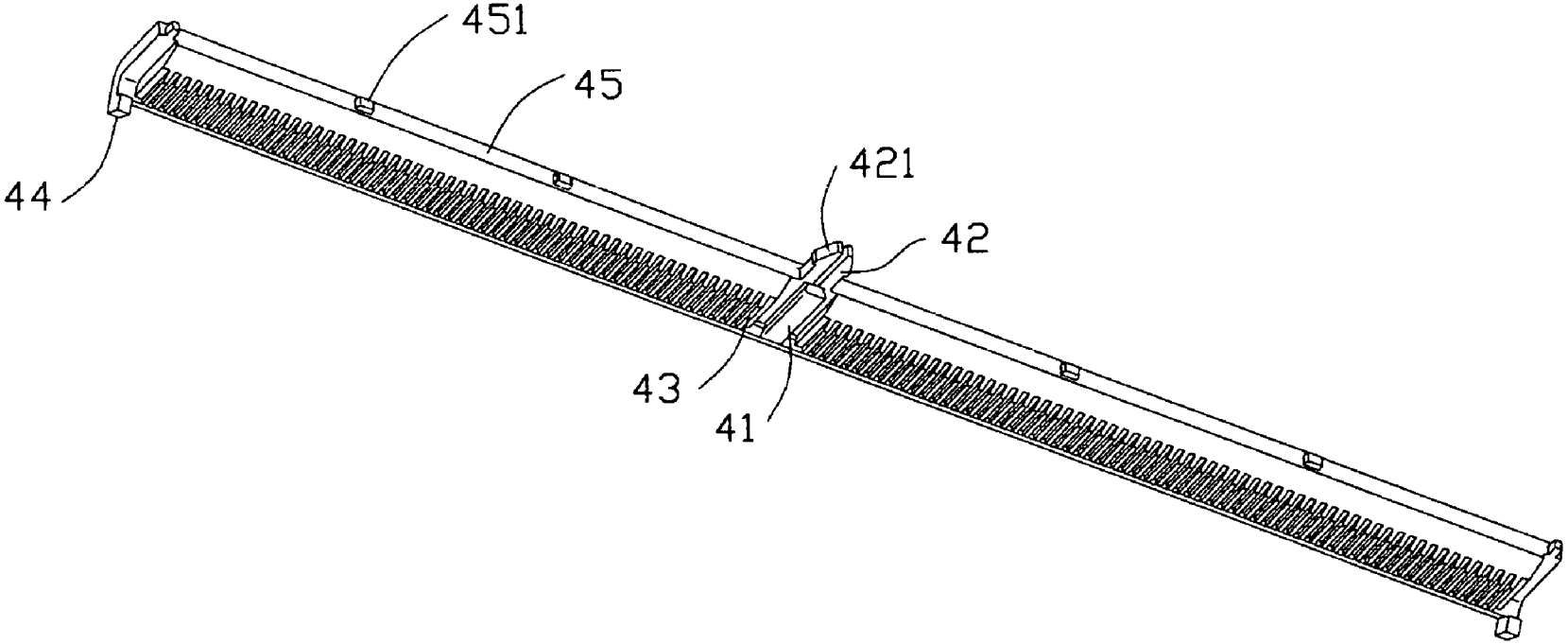
FIG. 6 is a perspective view of a cover of the slanted type card edge connector in accordance with the present invention.

Turning to FIG. 6 in conjunction with FIG. 1, the cover 4 is formed as an elongated plate made from insulating material. Protrusions/stoppers 44 are formed at two opposite longitudinal ends of the cover 4. A plurality of tabs 451 protrudes from a front face 45 of the cover 4. A series of grooves 43 are formed in an undersurface of the cover 4 for receiving corresponding medial portion 32 of the contacts 4. A locating block 41 is provided on the undersurface of the cover 4. A locking portion 42 extends forwardly from the front surface 45 of the cover 4. The locking portion 42 comprises a pair of hook portion 421 configured to be received in the retaining, through hole 23.

Figure 4:
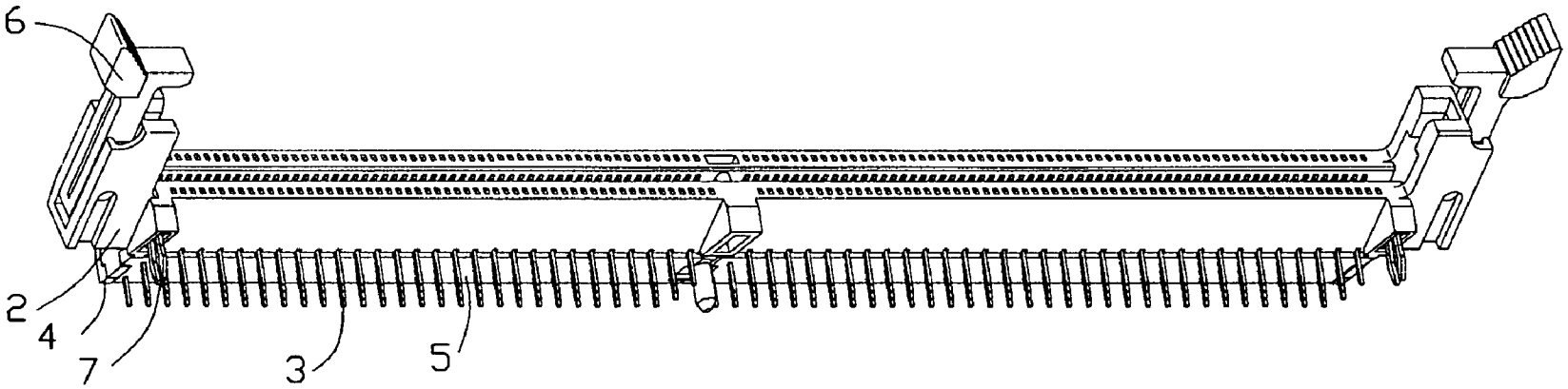
FIG. 4 is an assembled perspective view of the slant type card edge connector shown in FIG. 3.

Referring to FIGS. 3 and 4, the spacer 5 defines a plurality of through holes 51 for receiving corresponding soldering tails 33 of the contacts 3. As a result, the contacts 3 are positioned in their proper position securing mechanical and electrical connection between the connector 1 with the PCB.

In assembly, the mating portions 31 of the contacts 3 are received in respective passageways 20 of the insulating housing 2 and protrude into the central slot 29 to mate with the mating electronic card. The medial portions 32 and the soldering tails 33 of the contacts 3 are all exposed outside the insulating housing 2. The spacer 5 is assembled to the insulating housing 2 with the soldering tails 33 passing through the holes 51 defined in the spacer 5. The pair of ejectors 6 is received in respective towers 26, which perform a locking and ejection function with regard to the mating electronic card. The board-locks 7 are retained in the board-lock retaining holes 281. The cover 4 is assembled to the insulating housing 2 in the extending direction of the passageways 20. The locating block 41 of the cover 4 engages with the dove-tailed, retaining cavity 22 of the retaining section 21 so as to prevent the cover from moving in a direction perpendicular to the extending direction of the retaining section 21. The locking portion 42 enters and is retained in the retaining, through hole 23 defined in the housing 2. The hook portion 421 of the locking portion 42 locks with the protrusions formed on inner face of the retaining, through hole 23 to prevent the cover from moving along the extending direction of the retaining section 21. The grooves 43 of the cover 4 receive the corresponding medial portions 32 of the contacts 3. The pair of protrusions 44 of the cover 4 abuts against the steps 241 of the clapboards 24 and the tabs 451 engage within the grooves 251 of the insulating housing 2 which further ensure a firm engagement between the cover 4 and the insulating housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for being mounted on a printed circuit board, comprising:

an elongated, insulating housing defining a front mating face, a mounting face, a rear face, and a plurality of passageways therethrough, and comprising a retaining section extending rearwards from the rear face of the insulating housing, the retaining section defining a retaining cavity;

a plurality of contacts received in corresponding passageways of the insulating housing; and a cover comprising a protruding locating block and being retained in the retaining cavity of the insulating housing;

wherein a width of an upper side of the retaining cavity is smaller than that of a lower side thereof;

wherein the insulating housing defines a hole communicating with the retaining cavity, and wherein the cover has a locking portion extending forwards from a front face thereof and retained in the hole;

wherein the insulating housing has a pair of clapboards protruding rearwards from two opposite side edges thereof, the retaining cavity is located in between a pair of clapboards, each clapboard forming a step at a free end thereof, and wherein the cover forms a pair of protrusions abutting against the steps;

wherein the insulating housing defines a plurality of grooves in the rear face, and wherein the cover forms a plurality of tabs protruding from the front face thereof and engaging within the grooves;

wherein the contacts each include a mating portion received in a corresponding passageway, a soldering tail extending outside the insulating housing and a medial portion interconnecting the mating portion and the soldering portion;

wherein the cover defines a plurality of grooves for receiving corresponding medial portions of the contacts;

wherein the front mating face is slanted to the mounting face so that the connector is mounted on the printed circuit board at a certain degree;

wherein a spacer with a plurality of through holes defined therein, and wherein the soldering tails of the contacts pass through corresponding holes defined in the spacer;

wherein a pair of ejectors assembled at two ends of the insulating housing;

wherein a plurality of board-locks, and wherein the insulating housing defines a plurality of board-lock retaining holes in the mounting face of the insulating housing for receiving the board-locks.

* * * * *